US007698876B2

(12) United States Patent
Mäkinen

(10) Patent No.: US 7,698,876 B2
(45) Date of Patent: Apr. 20, 2010

(54) METHOD AND APPARATUS FOR PACKAGING REELS

(75) Inventor: Jukka Mäkinen, Hollola (FI)

(73) Assignee: Metso Paper, Inc., Helsinki (FI)

( * ) Notice: Subject to any disclaimer, the term of this patent is extended or adjusted under 35 U.S.C. 154(b) by 0 days.

(21) Appl. No.: 11/663,875

(22) PCT Filed: Sep. 27, 2005

(86) PCT No.: PCT/FI2005/000409

§ 371 (c)(1),
(2), (4) Date: May 2, 2007

(87) PCT Pub. No.: WO2006/035105

PCT Pub. Date: Apr. 6, 2006

(65) Prior Publication Data

US 2008/0053044 A1 Mar. 6, 2008

(30) Foreign Application Priority Data

Sep. 28, 2004 (FI) ..... 20041252

(51) Int. Cl.
*B65B 11/04* (2006.01)

(52) U.S. Cl. ..... 53/461; 53/410; 53/136.2; 53/204

(58) Field of Classification Search ..... 53/410, 53/461, 136.2, 136.3, 204, 214
See application file for complete search history.

(56) References Cited

U.S. PATENT DOCUMENTS

| | | | | |
|---|---|---|---|---|
| 1,091,139 | A * | 3/1914 | Jagenberg | 206/410 |
| 1,840,222 | A | 1/1932 | Brown | |
| 3,342,014 | A * | 9/1967 | Prager | 53/214 |
| 3,393,492 | A * | 7/1968 | Lamon et al. | 53/136.2 |
| 4,137,690 | A * | 2/1979 | Morgan | 53/176 |
| 4,303,462 | A * | 12/1981 | Karr | 156/538 |
| 4,339,904 | A * | 7/1982 | Koutonen et al. | 53/136.2 |
| 4,505,387 | A * | 3/1985 | Seto | 206/414 |
| 4,534,151 | A * | 8/1985 | Schneck et al. | 53/415 |
| 4,679,376 | A * | 7/1987 | Ekblom | 53/136.2 |
| 4,820,374 | A * | 4/1989 | Lamb | 156/538 |
| 5,090,566 | A * | 2/1992 | Yount | 206/416 |

(Continued)

FOREIGN PATENT DOCUMENTS

DE 15 86 018 A1 7/1970

(Continued)

OTHER PUBLICATIONS

"System Solutions for Roll Handling During Paper Making", Kleinewefers GmbH, pp. 1-20.

*Primary Examiner*—Paul R Durand
(74) *Attorney, Agent, or Firm*—Cohen Pontani Lieberman & Pavane LLP

(57) ABSTRACT

The invention relates to a method and arrangement for packaging paper, pulp, or board reels (1). In the method the reel (1) is brought to a wrapping station, which comprises supporting elements (2, 2') for supporting the reel (1) during wrapping end shields (7) are brought to the ends of the reel (1), wrapping material is wrapped around the reel (1), and the reel (1) is moved away from the wrapping station. According to the invention, the end shields (7) are brought to the ends of the reel (1) from the same side of the supporting elements (2, 2') as the wrapping material.

13 Claims, 2 Drawing Sheets

U.S. PATENT DOCUMENTS

| | | | | | |
|---|---|---|---|---|---|
| 5,265,399 | A | | 11/1993 | Niskanen et al. | |
| 5,533,321 | A | | 7/1996 | Hooper et al. | |
| 5,546,729 | A | * | 8/1996 | Pienta | 53/211 |
| 5,572,848 | A | * | 11/1996 | Wall | 53/136.2 |
| 5,642,600 | A | * | 7/1997 | Hooper et al. | 53/415 |
| 5,761,881 | A | * | 6/1998 | Wall | 53/415 |
| 5,960,608 | A | * | 10/1999 | Ohtonen | 53/415 |
| 5,983,606 | A | | 11/1999 | Hannen et al. | |
| 6,298,634 | B1 | | 10/2001 | Cramer | |

FOREIGN PATENT DOCUMENTS

| | | | |
|---|---|---|---|
| EP | 0 963 909 | A | 12/1999 |
| EP | 1 209 082 | A | 5/2002 |
| FI | 864854 | | 5/1988 |
| FI | 910665 | | 8/1992 |
| FI | 90959 | | 1/1994 |
| GB | 2197842 | | 6/1988 |

* cited by examiner

METHOD AND APPARATUS FOR PACKAGING REELS

PRIORITY CLAIM

This is a national stage of PCT application No. PCT/FI2005/000409, filed on Sep. 27, 2005. Priority is claimed on application No. 20041252, filed in Finland on Sep. 28, 2004.

FIELD OF THE INVENTION

The present invention relates to a method and apparatus for packaging paper, board, or pulp reels. The reel to be packaged is brought to a wrapping station and end shields are fastened to the ends of the reel and a wrapping material is wrapped on top of the surface of the jacket of the reel, after which the reel is moved away from the wrapping station.

BACKGROUND OF THE INVENTION

A wide paper reel coming from a paper machine is first of all taken to a slitter-winder and cut into customer reels of a suitable width. Next, the reels are packaged for transporting. When packaging paper reels, inner end shields are first of all placed on their ends, after which the necessary amount of wrapping is wrapped around them, the ends of which are folded on top of the inner end shields on the ends of the reels. An outer end shield is usually glued by hot sealing on top of the folded end of the wrapping and the inner end shield. The inner end shield is usually quite thick and its task is to protect the end of the reel from mechanical damage. For its part, the outer end shield is thinner and its task is to hold the packaging onto the end of the reel and to protect the reel from moisture. Colouring and patterns are often used on the outer end shield to try to give the reel a tidy appearance. The length and diameter of the reel to be packaged are measured prior to packaging and on the basis of the measurement results end shields of a suitable size are selected for the reel ends. A reel packaging line usually comprises several consecutive stations, by means of which the necessary operations are performed. Reels are moved between stations by a conveyor or by rolling.

The end shields can be placed on the end of the reels in many different ways. Placing the shield by hand is the oldest method and one that is still suitable for packaging lines with a reasonably small capacity, or in installations in which there is no need to increase the degree of automation. The packer then simply places the inner shields by hand on the ends of the reel and the outer shields correspondingly on the heat-pressing plates, which press the outer shields onto the ends of the reel. The inner shields can also be transferred by an air blast or by hand without mechanical contact. The inner shields are held on the end on the reel on a separate arm, or by an air blast while the edges of the wrapping are folded. The outer shields are, in turn, attached to the press plates by vacuum suction and are pressed onto the ends of the reel using the press plates. When setting the shields by hand, the packer ensures that shields of the correct size are put on the reel and that they are positioned correctly.

Various kinds of automatic end-shield setters have already been used for a long time and several different kinds of them exist. Nearly all the automatic shield setters have the common feature that at each end of the reel there is a device comprising a grab, which transfers a shield from the stack of shields to the end of the reel. In one known shield setter, there is a rotating arm mounted on a vertical guide, at the end of which arm there is a rotating vacuum sucker for gripping the shields. Shield setters of this kind are normally used in conjunction with racks of shield shelves located next to the setter. Using such a device, the shields are placed on the end of the reel, in such a way that the arm of the grab is moved along the vertical guide to the height of the shelf on which there are end shields of the correct size. The grab arm and sucker are turned, until the sucker is aligned parallel to the plane of the shelf, after which the shield is picked up from the shelf and the arm and sucker are moved to the reel end by rotating them and moving them along the guide. Instead of shelves, the end shields can be placed in stacks on the mill floor, or in a rotating shield magazine.

Instead of the aforementioned manner of handling end shields, a standard-model industrial robot with several degrees of freedom can be used to handle shields. A robot of this kind can be located in connection with the wrapping station, in such a way that it can place an end shield on both ends of the reel. The efficient operation of the robot requires a two-sided grab to be used, by means of which the grab can be rotated to pick up shields for both ends can be picked up one after the other, so that two lifting movements will not be required. It is also possible to use two robots to achieve a shorter cycle time.

End shields can also be placed on the reel ends from stacks on the mill floor, by using portal-action shield setters. The transfer portal is constructed above the shield stacks and the shield setters are generally installed on the same transverse movable guide. There is a separate shield setter for each side of the reel and each shield setter must have its own stack of end shields of a specific size. The end-shield stacks are placed in a matrix pattern on the floor of the mill hall.

SUMMARY OF THE INVENTION

The present invention is intended to create an improved method and apparatus for packaging paper, board, or pulp reels.

The invention is based on the end shields being brought to the ends of a reel supported by the wrapping station's support elements, for example carrier rollers, from the same side of the reel support elements as that from which the wrapping material is fed to the reel. In the apparatus according to the invention, the end-shield feed devices and the wrapping-material feed devices are arranged on the same side of the support elements.

Considerable advantages are gained with the aid of the invention.

Because the end shields and the wrapping material are fed from only one side of the support elements, it is simpler to arrange the material flow to the storage locations of the end shields and wrapping material of the feed systems. Generally, the end shields and wrapping material are brought to the machine level using the same materials lift, so that the location of the lift can be optimized with the aid of the invention, relative to the reel-wrapping line, in such a way that the end shields or the wrapping material need not be transported to the opposite side of the reel-wrapping line. Thus there is no need for extra shield transporting conveyors or manipulators, by means of which the end shields would be transferred over the reel-processing line.

In one preferred embodiment of the invention, the shield-feed device is located above the feed path of the wrapping material, so that the wrapping station and its associated shield-feed system and wrapping-feed system can be located in a very small space.

BRIEF DESCRIPTION OF THE DRAWINGS

In the following, the invention is examined with the aid of the accompanying drawings.

DETAILED DESCRIPTION OF THE PRESENTLY PREFERRED EMBODIMENTS

Figure 1:
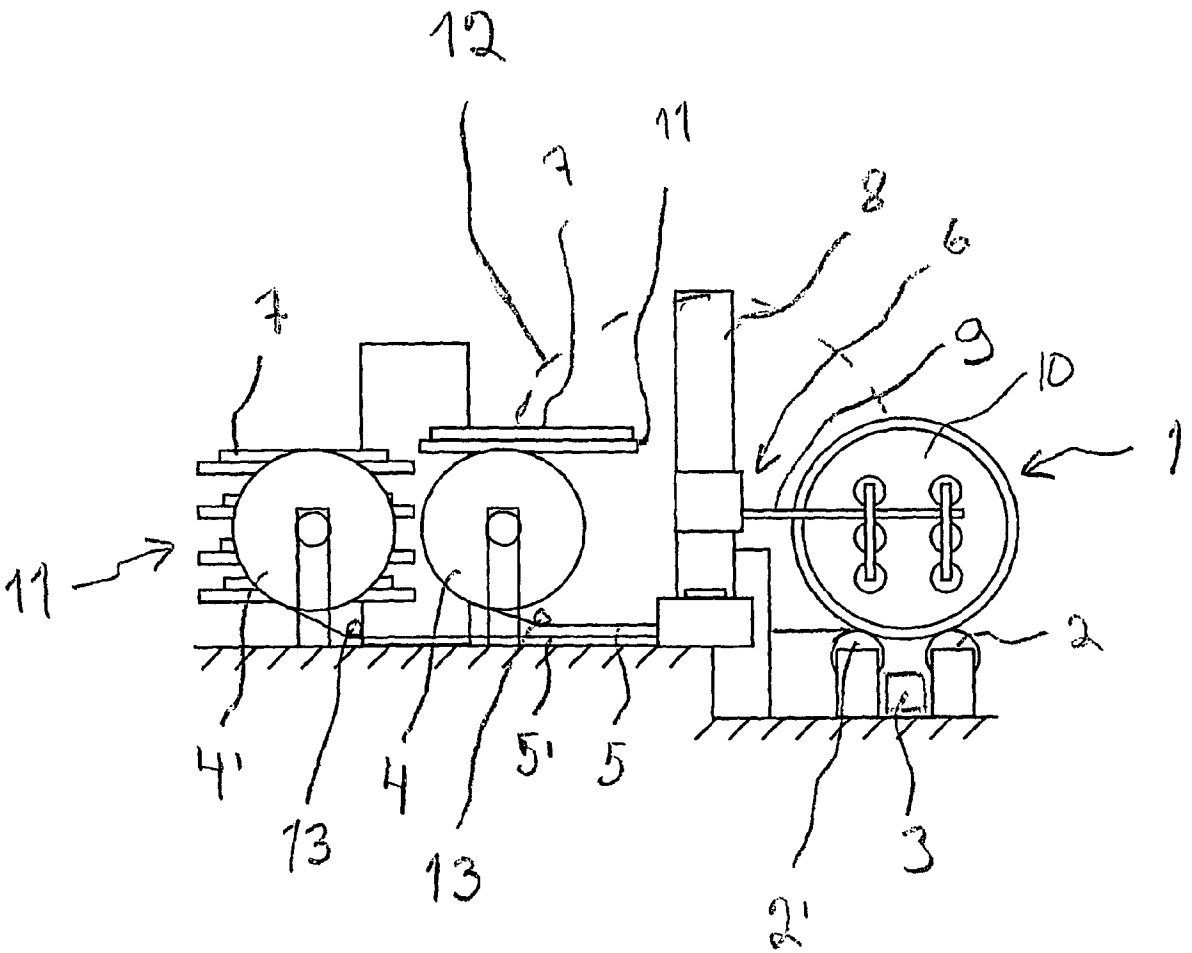
FIG. 1 shows one arrangement according to the invention, seen from the end of the reel.
Figure 2:
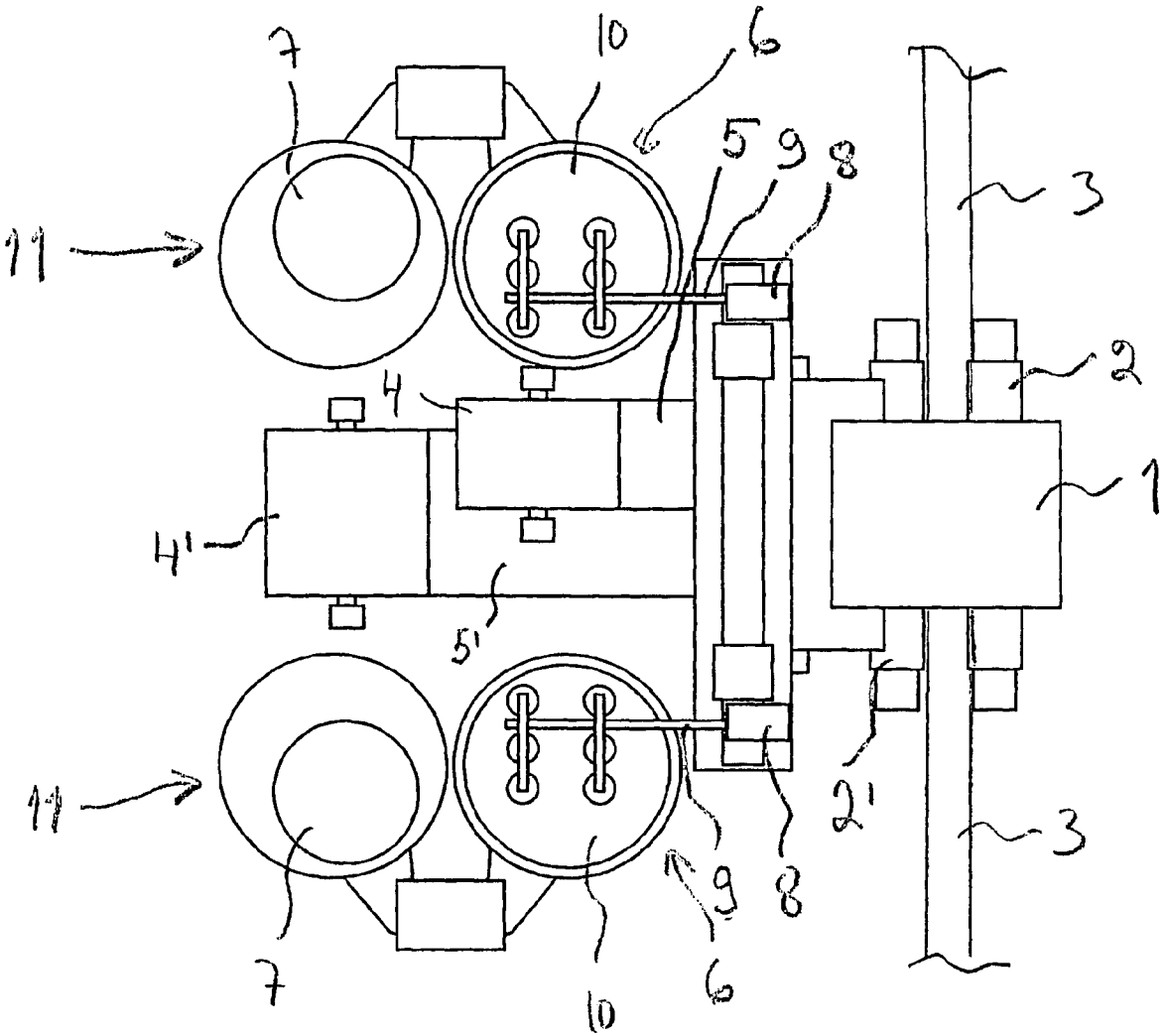
FIG. 2 shows a top view of the wrapping station of FIG. 1.

The wrapping station of FIG. 1 comprises two elongated carrier rollers 2, 2' placed at a distance from each other, by means of which the reel 1 is supported during wrapping. The carrier rollers 2, 2' can be rotated to rotate the reel 1. The reel 1 is placed on top of the carrier rollers 2, 2', in such a way that the carrier rollers' 2, 2' central axes are parallel to the central axis of the reel 1. The reel 1 is brought to the wrapping station and taken from the wrapping station to the following processing stage using one or more conveyors 3. The conveyor 3 can be, for example, a step conveyor that only runs between back and forward between consecutive stations, or a slat conveyor, in which an endless chain of slats, on which the reel is placed, is arranged to travel around two return rollers. The reel 1 is transported between stations, in such a way that its central axis is parallel to the direction of travel. Preferably, the carrier rollers 2, 2' can be moved vertically, in order to lift the reel 1 off the conveyor 3, and to lower it onto the conveyor 3. If necessary, the carrier rollers can be made to move in an axial direction.

In addition, in conjunction with the wrapping station there is a reel or reels of wrapping material, which is/are located in stands next to the carrier rollers 2. In the embodiment according to FIG. 1, there are two wrapping-material reels 4, 4' arranged one after the other, but there can be even more consecutive wrapping-material reels. The wrapping material is led from the wrapping-material reel 4, 4' using a feed device between the reel 1 being wrapped and the carrier roller 2' on the wrapping-material reel 4, 4' side. Typically, there are guide rollers 13 in the feed device for guiding the wrapping material and nips, between which the wrapping material runs. The feed paths 5, 5' of the wrapping material are on top of each other, in such a way that the feed path 5' of the wrapping material reel 4', which is farthest from the reel 1 being wrapped, travels beneath the feed path 5 of the wrapping-material reel 4 that is closer.

The wrapping station also comprises wrapping-material cutting devices, by means of which the wrapping is cut after wrapping. Generally, the wrapping stations also has gluing devices, by means of which glue is spread on the wrapping, securing it to the reel 1 being wrapped. Instead of glue, the wrapping can be secured to the reel 1, for example, using hot sealing or tape.

End-shield feed devices 6, by means of which the end shields 7 are placed on the ends of the reel 1, are also arranged in connection with the wrapping station. The end-shield feed devices 8 operate automatically, i.e. the transfer the end shields from a storage location in the vicinity of the wrapping station to the ends of the reel 1 automatically, without manual human labour at the wrapping station.

In the embodiment according to the drawings, the end-shield feed device 6, is a rotating arm 9 set on a vertical guide 8, at the end of which arm there is a rotating vacuum sucker 10 for gripping the shields 7. In the embodiment according to the drawings, there are two feed devices 6, one on either side of the feed path 5, 5' of the wrapping material. In the vicinity of the feed device 6, shield shelves 11 are located, in which there are end shields 7 of different sizes. The shields 7 are transferred by the shield feed device 6 onto the end of the reel 1, in such a way that the arm 9 of the sucker 10 is moved along the vertical guide 8 to the height of the shelf on which there are end shields of the correct size. The arm 9 and the sucker 10 are rotated, until the sucker 10 is aligned parallel to the plane of the shelf, after which the shield 7 is picked up from the shelf and transferred to the end of the reel 1 by rotating the arm 9 and the sucker 10 and moving the arm 9 along the guide 8. Alternatively, the end shields can be placed in stacks on the floor of the mill hall, from where they are transferred to the ends of the reel 1, for example, by using a shield feed device 6 that moves along a guide.

Instead of the aforementioned ways of handling the end shields, a standard-model industrial robot with several degrees of freedom can be used as the feed device for the end shields. Such a robot can be located in conjunction with the wrapping station, in such a way that it can be used to place an end shield 7 on each end of the reel 1. For the robot to be able to operate effectively, two-sided grabs are used in it, by means of which the shields 7 for each end can be picked up one after the other by rotating the grab, in which case two picking movements will not be needed. Thus the first end shield is taken first to the end of the reel 1, after which the grab moves to the other end of the reel 1 and sets the end shield in place on the other end of the reel.

In the feed of the end shields, it is also possible to use both of the feed devices referred to above, in such a way that the robot picks up the end shields from the stacks and transfers the shields to an intermediate transfer manipulator, which then transfers the shields to the ends of the reel.

The shield shelves 11 or the shield stacks are located on the same side of the carrier rollers 2, 2' are the wrapping paper feed devices, preferably in the vicinity of the shield feed device next to the feed path 5, 5' of the wrapping material. The end-shield feed device or devices 6 is/are also located on the same side of the carrier rollers as the feed devices for the wrapping material.

In one preferred embodiment of the invention, the end-shield feed device is located above the feed path 5, 5 of the wrapping material. The frame of the feed device is attached, for example, to a horizontal beam that is above the feed path 5, 5' of the wrapping material.

Wrapping folding devices (not shown) are also arranged in conjunction with the wrapping station, by means of which the parts of the wrapping that extend over the ends of the reel 1 are folded against the end shields. The folding devices are usually situated on the opposite side of the carrier rollers 2, 2' to the wrapping feed devices.

The reel 1 to be wrapped is brought on a conveyor 3 from the previous processing stations, to above the carrier rollers 2, 2', after which the carrier rollers 2, 2' are raised or the conveyor 3 is lowered, so that the reel 1 is transferred onto the carrier rollers 2, 2'. The shield feed device 6 is used to bring inner end shields 7 to both end of the roll 1 that is on the carrier rollers 2 2'. After this, the reel 1 is begun to be rotated by rotating the carrier rollers 2, 2'. The wrapping material is fed around the rotating reel 1 from one wrapping-material reel 4, through a nip between the reel 1 and the carrier roller 2' on the wrapping-material reel 4 side. Once there is a suitable amount of wrapping around the reel 1, the wrapping is cut by the cutting devices and glue is added by a gluing device to the end of the reel, so that the end of the wrapping is secured to the reel 1. If the wrapping material is not as wide as the reel, a second or more widths of wrapping are wrapped around the reel 1 using the lap-wrapping method, so that the entire surface of the jacket of the reel 1 is surrounded with wrapping. In lapped wrapping, a new round of wrapping is formed next to the previous round, in such a way that the edges of the wrapping rounds slightly overlap each other. The reel 1 is positioned for a new wrapping round by moving the carrier rollers 2, 2' and the reel axially, or by moving the wrapping roll 4 and the wrapping-feed device axially to the desired location on the reel 1. The reel 1 can also be positioned for a new wrapping round in such a way that the carrier rollers 2, 2' and the wrapping-feed devices are kept stationary while the reel 1 is moved to the desired position on top of the carrier rollers 2, 2' by a conveyor 3. The new wrapping round is fed from the same or a different wrapping reel as the previous wrapping round. Once the entire surface of the jacket of the reel 1 has been covered with wrapping, the portions of the wrapping material that extend beyond the ends of the reel are folded against the inner end shields by folding devices.

After this, the rotation of the reel 1 with the aid of the carrier rollers 2, 2' is stopped and the reel 1 is transferred to the conveyor 3, either by lowering the carrier rollers 2, 2', or by raising the conveyor 3, and is then transported to the following processing stage.

The transfer of the end shields 7 from the storage location 11 in the vicinity of the wrapping station to the ends of the reel 1 is implemented in such a way that the feed device 6 picks up an end shield 7 of the desired size from the shield shelf or the shield stack. After this, the feed device 6 sets the shield 7 in place on the end of the reel 1. The shield-feed path 12 of the feed device 6 is higher that the feed path 5, 5' of the wrapping material. The end shield 7 is brought to the end of the reel 1 from the same side of the carrier rollers, 2, 2' and the conveyor 3 as the wrapping material, i.e., for example, in the embodiment according to the drawings, from the left-hand side of the carrier rollers 2, 2' and the conveyor 3. The feed path 12 of the end shield 7 can run on the same alignment as the wrapping-material feed path 5, 5', or beside the wrapping-material feed path 5, 5', but however for the entire duration transfer at a higher level that the wrapping-material feed path 5, 5' between the wrapping-material reel 4, 4' and the reel 1 being wrapped.

Alternatively, the feed of the end shields can be arranged in such a way that the feed device picks up the end shields for both ends from the storage location. After this, the feed device moves the first shield into place on the end of the reel and the moves to the other end of the reel and sets the second end shield in place on the other end of the reel.

The invention has embodiments that differ from those disclosed above.

Instead of lapped wrapping, the reel can be wrapped using so-called spiral wrapping. In spiral wrapping, the wrapping-material reel and the wrapping feed device are moved parallel to the axis of the reel 1 during wrapping, so that the wrapping material is wrapped in a spiral around the reel 1, in such a way that the edges of the layers of wrapping overlap. A spiral wrapping layer can also be formed in such a way that the carrier rollers 2, 2' and the reel 1 are moved parallel to the centre axis of the reel 1 during the wrapping feed.

Even though lapped or spiral wrapping is preferably used in the invention, the reel can be wrapped using a single round of wrapping, providing the wrapping material is sufficiently wide.

What is claimed is:

1. A method for packaging paper, pulp, or board reels, the method comprising:

transporting a reel to a wrapping station by a conveyor along a transport path, the wrapping station comprising supporting elements for supporting the reel during wrapping and the conveyor running between the support elements, wherein the step of transporting is carried out without moving the reel laterally from the conveyor toward the wrapping station for wrapping;

wrapping the reel with a wrapping material fed from at least one feeding device while the reel is supported on the supporting elements;

winding the wrapping material around an entire surface of a jacket of the reel;

bringing, from a storage location, end shields to ends of the reel, the storage location storing end shields of different sizes; and moving the reel away from the wrapping station by the conveyor, wherein the end shields are brought to the ends of the reel from the same side of the supporting elements as the wrapping material, and wherein the step of bringing end shields is carried out when the reel is supported on the supporting elements and in the transport path through which the conveyor extends.

2. The method of claim 1, wherein a feed path of the end shields is higher than a feed path of the wrapping material.

3. The method of claim 2, wherein the wrapping material is wrapped around the reel using lapped wrapping or spiral wrapping.

4. The method of claim 1, wherein the wrapping material is wrapped around the reel using lapped wrapping or spiral wrapping.

5. The method of claim 1, wherein the conveyor comprises first and second conveyors for respectively transporting a reel to and from the wrapping station.

6. The method of claim 5, wherein the first and second conveyors are separate conveyors.

7. The method of claim 1, wherein the step of moving is carried out without moving the reel laterally from the wrapping station toward the conveyor.

8. An apparatus for packaging paper, pulp, or board reels, the apparatus comprising:

a wrapping station comprising supporting elements for supporting a reel during wrapping and at least one conveyor for transporting the reel to and from the wrapping station, the at least one conveyor running between the supporting elements;

at least one storage location storing end shields of different sizes;

an end-shield feed device for moving one or more of the end shields to ends of the reel on the wrapping station; and one or more wrapping material feed devices for feeding a wrapping material from at least one wrapping material reel to the reel on the wrapping station, the wrapping material being adapted to wrap around substantially an entire surface of a jacket of the reel, wherein the storage location and the end-shield feed device are arranged on the same side of the supporting elements as the wrapping material feed devices, and wherein the end-shield feed device applies said one or more of the end shields to ends of the reel supported on the supporting elements and in the transport path through which the conveyor extends.

9. The apparatus of claim 8, wherein a feed path of the end-shield feed device is arranged to be higher than a feed path of the wrapping material.

10. The apparatus of claim 9, wherein the end-shield feed device is arranged above the feed path of the wrapping material.

11. The apparatus of claim 8, wherein the end-shield feed device is arranged above the feed path of the wrapping material.

12. The apparatus of claim 8, wherein the conveyor comprises first and second conveyors for respectively transporting a reel to and from the wrapping station.

13. The apparatus of claim 12, wherein the first and second conveyors are separate conveyors.

* * * * *